United States Patent [19]

Kato et al.

[11] Patent Number: 4,747,916

[45] Date of Patent: May 31, 1988

[54] PLATING BATH FOR ELECTRODEPOSITION OF ALUMINUM AND PROCESS FOR THE SAME

[75] Inventors: Yoshio Kato, Nishinomiya; Setsuko Takahashi, Misato, both of Japan

[73] Assignee: Nisshin Steel Co., Ltd., Tokyo, Japan

[21] Appl. No.: 92,517

[22] Filed: Sep. 3, 1987

[51] Int. Cl.[4] ..... C25D 3/44

[52] U.S. Cl. ..... 204/58.5

[58] Field of Search ..... 204/39, 58.5

[56] References Cited

U.S. PATENT DOCUMENTS 2,446,331 8/1948 Hurley ..... 204/39

2,446,349 8/1948 Wier, Jr. et al. ..... 204/58.5

2,446,350 8/1948 Wier, Jr. et al. ..... 204/39

*Primary Examiner*—T. M. Turfariello

*Attorney, Agent, or Firm*—Foley & Lardner

[57] ABSTRACT

In a plating bath for electrodeposition of aluminum, comprising a nonaqueous electrolyte using a eutectic mixture fusible at room temperature, the plating bath comprises a mixture of about 40 to 80 mol % of an aluminum halide and about 20 to 60 mol % of butyl pyridinium halide, or further comprises an organic solvent mixed in said mixture. This plating bath may not cause any color change of a coating into gray or black to assure white and uniform appearance, even when current density is increased to 30 $A/dm^2$ or varied in the range from 0.1 to 30 $A/dm^2$.

6 Claims, No Drawings

PLATING BATH FOR ELECTRODEPOSITION OF ALUMINUM AND PROCESS FOR THE SAME

BACKGROUND OF THE INVENTION

This invention relates to a plating bath for electrodeposition of aluminum and a process for the same.

U.S. Pat. No. 2,446,331, No. 2,446,349 and No. 2,446,350 disclose a process for electrodeposition of aluminum by use of a nonaqueous electrolyte, which is a process carried out by using a plating bath comprising a mixture (a eutectic mixture) of an aluminum halide and a N-alkyl pyridinium halide. However, it is stated in the above patents that a good aluminum coating can be obtained when the aluminum halide comprises aluminum chloride and the N-substituent for the N-alkyl pyridinium halide comprises an ethyl group, and there is no disclosure as to the examples where the N-substituent for N-alkyl pyridinium halide comprises other alkyl groups.

The N-ethyl pyridinium halide used when a plating bath is prepared is not commercially available since there is no demand therefor even as a reagent. For this reason, it must be synthesized when used for preparing a plating bath. Synthesis therefor can be achieved by reacting an ethyl halide with pyridine. However, the ethyl halide, which is gaseous, has a disadvantage that it is in danger of explosion during its synthesis.

Also, in carrying out the electrodeposition of aluminum in an industrial scale, it has been necessary to carry out plating under high current density in order to make high the plating speed, and also to control appearance to be uniform even with change in the current density. However, plating under high current density with use of a plating bath comprising the mixture of aluminum chloride and N-ethyl pyridinium halide, the appearance may suffer color-changed and constant appearance may be assured only within a very narrow range of the current density. For example, in the instance of the plating bath disclosed in U.S. Pat. No. 2,446,331, the current density at which a coating having appearance of aluminum can be obtained is 0.5 A/dm$^2$, and the density lower than that may result in a cloudy appearance. On the other hand, the current density higher than that may result in a grayish appearance, and the density excessively higher that that may result in generation of black spots. Also, in the instance of the plating bath disclosed in U.S. Pat. No. 2,446,349, an optimum current density is 0.5 to 1.0 A/dm$^2$, and the density higher than 1.0 A/dm$^2$ may result in generation of blown colored streaks. Accordingly, these plating baths can be suited for batch plating for the parts (for example, screw thread, rivets, frames, etc, for aircrafts), but, in the continuous plating where the plating is carried out while a metallic band is moved at constant speedd, the plating can be achieved taking an overly long time to seriously lower the productivity. It is also difficult to make uniform the appearance as a whole of the metallic band.

SUMMARY OF THE INVENTION

This invention aims at providing a plating bath, and a plating process, that can safely synthesize the N-alkyl pyridinium halide to be used, and may not cause any change in appearance even at the current density increased to 30 A/dm$^2$ and the current density varied in the range from 0.1 to 30 A/dm$^2$.

According to this invention, there are provided a plating bath for electrodeposition of aluminum, comprising a mixture of about 40 to 80 mol % of an aluminum halide ($AlX_3$, wherein X represents Cl, Br of I) and about 20 to 60 mol % of butyl pyridinium halide ($C_2H_5N$—($C_4H_9$)X, wherein X represents a halogen atom), and a plating bath further comprising an organic solvent mixed in the above plating bath. With use of any of these plating baths, the electrodeposition is effected on a metal in a dried and oxygen free atmosphere using a direct current or pulse current, at a bath temperature of 0° to 150° C. and at a current density of 0.1 to 30 A/dm$^2$.

DESCRIPTION OF THE PREFERRED EMBODIMENTS

The mixture of about 40 to 80 mol % of an aluminum halide and about 20 to 60 mol % of butyl pyridinium halide is a eutectic mixture fusible at room temperature. Accordingly, the electrodeposition of aluminum can be achieved by flowing a current with use of a metal on the cathode.

The aluminum halide may include $AlCl_3$, $AlBr_3$ and $AlI_3$, which can be used alone or as a mixture of any of these. The concentration thereof in a bath may be controlled to be about 40 to 80 mole %. The concentration less than 40 mol % may result in higher concentration of butyl pyridinium ions and simultaneous progress of the reduction of the butyl pyridinium ions, causing the deterioration of the bath, a lowering of the current efficiency and the poorness in the surface appearance of a coating. On the other hand, the concentration more than 80 mol % may result in a lowering of conductivity and also result in an increased vapor pressure.

Controlling the concentration of the aluminum halide to the value as mentioned above, the remaining is comprised of the butyl pyridinium halide, and it follows that the latter is in concentration of 20 to 60 mol %. This compound may preferably include those in which the halogen atom is Cl, Br or I.

The plating bath may be prepared by mixing the aluminum halide and the butyl pyridinium halide according to the procedures as disclosed in U.S. Pat. No. 2,446,349. In the mixing, the butyl pyridinium halide, which is not commercially available, must be synthesized beforehand. The synthesis thereof may be carried out by reacting a halogenated butyl with pyridinium. Since the halogenated butyl is a solid, there is no danger of explosion.

The plating bath having the above composition remains somewhat viscous at room temperature, and, in continuous plating, a member to be plated may excessively carry away the plating solution, whereby the plating solution may be consumed in greater proportion. Also, appearance of good mirror gloss can not be achieved. This problem can be solved by mixing an organic solvent in the plating bath. The organic solvent, preferable in view of the solubility, may include aromatic solvents, for example, toluene, benzene, xylene, etc. It may be mixed in an amount of 10 to 75 mol. % based on the total amount of the aluminum halide and butyl pyridinium halide (Accordingly, the total amount of both the halides is 25 to 90 vol. %). The amount of less than 10 vol. % may result in small effect of the mixing, and the amount more than 75 vol. % may result in a lowering of the concentration of the aluminum halide, thus extremely lowering the current efficiency at the time of the plating.

The plating bath can be kept safe even when it comes into contact with oxygen or water, but, in order to prevent the oxidation of aluminum complex ions, the plating is carried out in a dried and oxygen free atmosphere (for example, in a dried $N_2$ gas or Ar gas).

Electrolysis may be carried out in the dried and oxygen free atmosphere using a direct current or pulse current, at a bath temperature of 0° to 150° C. and at a current density of 0.1 to 30 A/dm$^2$. The bath temperature lower than 0° C. may cause the coagulation of a plating bath to make it difficult to carry out the plating at a high current density. The bath temperature higher than 150° C. and the current density higher than 30 may result in the formation of a grayish coating and also the formation of coarse dendritic crystals to make poor the appearance and the processability. When the electrolysis is carried out at a current density near to 30 A/dm$^2$, it is preferably to control the bath temperature to 100° C. or more. In the plating bath using the ethyl pyridinium halide, U.S. Pat. No. 2,446,331 also discloses that the bath temperature is controlled to 40° to 150° C. However, a color change may occur when the current density is higher than 0.5 A/dm$^2$. As to the current, application of a pulse current, rather than a direct current, can make crystals finer and can achieve better formability.

In order to always apply a uniform coating in continuously carrying out the plating in an industrial scale, it is required to supply Al ions to a plating bath to control the content of Al ions in the bath to a predetermined range. Here, aluminum may be used as a soluble anode, whereby aluminum can be supplied from the anode to make substantially constant the Al ion concentration in the bath. If, however, an insoluble anode (for example, a Ti-Pt alloy) is used, Al ions are consumed. In such an instance, Al ions may be supplied by adding $AlCl_3$, $AlBr_3$, $AlI_3$ or the like. However, employment of such an insoluble anode as the anode may cause a reaction to generate a halogen gas at the surface of the electrode to decrease the halogen components in the bath. Therefore, the bath composition may vary to shorten the life of a bath.

As mentioned above, a coating may suffer a color change at 1.0 A/dm$^2$ when ethyl pyridinium halide is used as the alkyl pyridinium halide. However, the plating bath of this invention does not cause any color change in the coating even at the current density increased to 30 A/dm$^2$, as mentioned above. This is presumably because, in the case of the ethyl pyridinium halide, the N-substituent (an ethyl group) is so small and the steric hindrance is so small that the ethyl pyridinium halide itself may undergo reaction at an increased current density, but, in contrast thereto, in the case of the butyl pyridinium halide, the N-substituent (a butyl group) is larger than the ethyl group, resulting in the steric hindrance to cause no reaction. As an example substantiating the reasonability of this, a coating turns black with much greater color change regardless of the current density, when a methyl pyridinium halide whose N-substituent is a methyl group smaller than the ethyl group.

EXAMPLES

Cold-rolled steel sheets (thickness: 0.5 mm) were subjected to solvent vapor cleaning, alkaline degreasing, acid pickling and so forth to clean their surfaces, followed by drying, and immediately thereafter dipped in a fused salt bath of $N_2$ atmosphere and comprising a mixture of an aluminum halide and a butyl pyridinium halide. Electroplating was carried out using a steel sheet as a cathode and an aluminum plate (purity: 99.993%; thickness: 5 mm) as an anode. Table 1a and Table 1b show the composition of the plating bath, the conditions for electrolysis, appearance after plating, and adherence of a coating.

The plating using the pulse current was carried out at a duty factor of 1/10 to 1/100, and the coating adherence was examined by bending.

TABLE 1a

| | Composition of plating bath | | | | | |
|---|---|---|---|---|---|---|
| | $AlX_3$ | | $C_5H_5N—(C_4H_9)X$ | | Organic solvent | |
| No. | Kind | mol % | Kind | mol % | Kind | mol % |
| 1 | $AlCl_3$ | 60 | $C_5H_5N—(C_4H_9)Cl$ | 40 | — | — |
| 2 | $AlCl_3$ | 60 | $C_5H_5N—(C_4H_9)Cl$ | 40 | Benzene | 60 |
| 3 | $AlCl_3$ | 60 | $C_5H_5N—(C_4H_9)Cl$ | 40 | Benzene | 60 |
| 4 | $AlBr_3$ | 67 | $C_5H_5N—(C_4H_9)Cl$ | 33 | Toluene | 60 |
| 5 | $AlCl_3$ | 67 | $C_5H_5N—(C_4H_9)Cl$ | 33 | — | — |
| 6 | $AlBr_3$ | 60 | $C_5H_5N—(C_4H_9)Cl$ | 40 | — | — |
| 7 | $AlCl_3$ | 60 | $C_5H_5N—(C_4H_9)Cl$ | 40 | Toluene | 50 |
| 8 | $AlBr_3$ | 60 | $C_5H_5N—(C_4H_9)Br$ | 40 | — | — |
| 9 | $AlI_3$ | 60 | $C_5H_5N—(C_4H_9)I$ | 40 | — | — |
| 10 | $AlCl_3$ | 67 | $C_5H_5N—(C_4H_9)Cl$ | 33 | — | — |
| 11 | $AlCl_3$ | 67 | $C_5H_5N—(C_4H_9)Cl$ | 33 | — | — |
| 12 | $AlCl_3$ | 67 | $C_5H_5N—(C_4H_9)Cl$ | 33 | Benzene | 40 |
| 13 | $AlCl_3$ | 67 | $C_5H_5N—(C_4H_9)Cl$ | 33 | Toluene | 40 |
| 14 | $AlCl_3$ | 67 | $C_5H_5N—(C_4H_9)Cl$ | 33 | Benzene/ toluene mixture | 40 |
| 15 | $AlCl_3$ | 67 | $C_5H_5N—(C_4H_9)Cl$ | 33 | — | — |
| 16 | $AlCl_3$ | 67 | $C_5H_5N—(C_4H_9)Cl$ | 33 | — | — |
| 17 | $AlCl_3$ | 67 | $C_5H_5N—(C_4H_9)Cl$ | 33 | — | — |
| 18 | $AlBr_3$ | 67 | $C_5H_5N—(C_4H_9)Br$ | 33 | — | — |
| 19 | $AlI_3$ | 67 | $C_5H_5N—(C_4H_9)I$ | 33 | — | — |

TABLE 1b

| | Conditions for electrolysis | | | | | |
|---|---|---|---|---|---|---|
| No. | Bath temp. (°C.) | Current | Current density (A/dm$^2$) | Electrolysis time (min) | Appearance | Coating adherence |
| 1 | 20 | Direct | 1 | 15 | White | Good |
| 2 | 20 | " | 5 | 5 | White, glossy | Good |
| 3 | 20 | Pulse | 10 | 5 | White, glossy | Good |
| 4 | 20 | Direct | 0.5 | 30 | White, glossy | Good |
| 5 | 60 | " | 10 | 2 | White | Good |
| 6 | 80 | " | 20 | 1 | White | Good |
| 7 | 50 | " | 0.5 | 30 | Glossy | Good |
| 8 | 30 | " | 5 | 5 | White | Good |
| 9 | 40 | " | 3 | 8 | White | Good |
| 10 | 0 | " | 1 | 15 | White | Good |
| 11 | 150 | " | 30 | 1 | White | Good |
| 12 | 30 | " | 10 | 3 | White, glossy | Good |
| 13 | 50 | " | 0.5 | 30 | Glossy | Good |
| 14 | 30 | " | 10 | 3 | Glossy | Good |
| 15 | −10 | " | 1 | 15 | Gray | Poor |
| 16 | 180 | " | 30 | 1 | Dendritic | Poor |
| 17 | 120 | " | 40 | 1 | Gray, black | Poor |
| 18 | 80 | " | 10 | 3 | White | Good |
| 19 | 100 | " | 10 | 3 | White | Good |

What is claimed is:

1. A plating bath for electrodeposition of aluminum, comprising a mixture of about 40 to 80 mol % of an aluminum halide ($AlX_3$, wherein X represents Cl, Br of I) and about 20 to 60 mol % of butyl pyridinium halide ($C_2H_5N$-($C_4H_9$)X, wherein X represents a halogen atom).

2. A process for electrodeposition of aluminum, comprising carrying out electroplating with use of a plating bath comprising a mixture of about 40 to 80 mol % of an aluminum halide ($AlX_3$, wherein X represents Cl, Br of I) and about 20 to 60 mol % of butyl pyridinium halide ($C_2H_5N$—($C_4H_9$)X, wherein X represents a halogen atom), on a metal in a dried and oxygen free atmosphere using a direct current or pulse current, at a bath temperature of 0° to 150° C. and at a current density of 0.1 to 30 A/dm$^2$.

3. A plating bath for electrodeposition of aluminum, comprising a mixture of about 40 to 80 mol % of an aluminum halide ($AlX_3$, wherein X represents Cl, Br of I) and about 20 to 60 mol % of butyl pyridinium halide ($C_2H_5N$-($C_4H_9$)X, wherein X represents a halogen atom), and an organic solvent mixed into said mixture.

4. The plating bath for electrodeposition of aluminum according to claim 1, wherein said organic solvent is of an aromatic type.

5. The plating bath for electrodeposition of aluminum according to claim 1, wherein said organic solvent is mixed in the proportion of 10 to 75 vol. %.

6. A process for electrodeposition of aluminum, comprising carrying out electroplating with use of a plating bath comprising a mixture of about 40 to 80 mol % of an aluminum halide ($AlX_3$, wherein X represents Cl, Br of I) and about 20 to 60 mol % of butyl pyridinium halide ($C_2H_5N$—($C_4H_9$)X, wherein X represents a halogen atom), and an organic solvent mixed into said mixture, on a metal in a dried and oxygen free atmosphere using a direct current or pulse current, at a bath temperature of 0° to 150° C. and at a current density of 0.1 to 30 A/dm$^2$.

* * * * *